United States Patent [19]

Rue et al.

[11] 4,253,850

[45] Mar. 3, 1981

[54] RESIN BONDED ABRASIVE BODIES FOR SNAGGING METAL CONTAINING LOW ABRASIVE AND HIGH FILLER CONTENT

[75] Inventors: Charles V. Rue, Petersham; Kesh S. Narayanan, Holden, both of Mass.

[73] Assignee: Norton Company, Worcester, Mass.

[21] Appl. No.: 67,710

[22] Filed: Aug. 17, 1979

[51] Int. Cl.[3] ..... B24B 1/00; C08J 5/14

[52] U.S. Cl. ..... 51/298; 51/296

[58] Field of Search ..... 51/298, 295, 296

[56] References Cited

U.S. PATENT DOCUMENTS

| | | | |
|---|---|---|---|
| 2,734,813 | 2/1956 | Zalud | 51/296 |
| 2,806,772 | 9/1957 | Robie | 51/296 |
| 3,183,071 | 5/1965 | Rue et al. | 51/298 |
| 3,273,984 | 9/1966 | Nelson | 51/296 |
| 3,383,191 | 5/1968 | Thomas | 51/298 |
| 3,385,684 | 5/1968 | Voter | 51/298 |
| 3,481,723 | 12/1969 | Kistler et al. | 51/298 |
| 3,528,788 | 9/1970 | Seal | 51/298 |
| 3,551,125 | 12/1970 | Hallewell | 51/298 |
| 3,632,320 | 1/1972 | Henmi et al. | 51/298 |
| 3,664,819 | 5/1972 | Sioui et al. | 51/298 |
| 3,864,101 | 2/1975 | Charvat | 51/298 |
| 3,899,307 | 8/1975 | Thompson | 51/298 |
| 3,957,461 | 5/1976 | Lindstrom | 51/298 |

*Primary Examiner*—Donald J. Arnold

*Attorney, Agent, or Firm*—Walter Fred

[57] ABSTRACT

Organic bonded abrasive bodies such as snagging wheels and wheel segments for conditioning billets, slabs, and castings have abrading portions with 0 to 8% pores by volume, a low abrasive content of from 24 to 45% by volume of 4 to 36 grit size abrasive, substantially constant volume of a thermosetting resin of from 18 to 24% by volume and a high content of filler material constituting from 29% to 56% by volume of the body and wherein at least 80% by volume of the filler material is inorganic material.

14 Claims, No Drawings

RESIN BONDED ABRASIVE BODIES FOR SNAGGING METAL CONTAINING LOW ABRASIVE AND HIGH FILLER CONTENT

TECHNICAL DISCLOSURE

The invention relates to organic bonded abrasive bodies and particularly to hot pressed resinoid bonded snagging wheels and segments having abrading portions of substantially zero porosity, low abrasive-high filler and substantially constant resin content for conditioning metal billets, ingots, slabs and castings.

This invention provides strong, safe and highly efficient snagging wheels at relatively lower cost by increasing the filler content, conserving and reducing the abrasive content from that taught to be necessary and normally used heretofor in snagging wheels of comparable size and volume.

BACKGROUND ART

In the present state of the art resinoid bonded snagging wheels for conditioning steel billets are comprised primarily of abrasive grain, phenolic resin and fillers.

Generally, the abrasive grains are selected from the group consisting of fused aluminum oxide, fused alumina-zirconia, sintered alumina-zirconia, sintered alumina, sintered bauxite and to a lesser extent silicon carbide.

The phenolic resin portion of the wheel is usually a thermoset mixture of phenolic novolac and hexamethylenetetramine.

The filler portion of the wheel varies from one manufacturer to another, each manufacturer varies fillers to get optimum performance for a particular application. For example, a filler of iron pyrites and potassium fluoborate performs well on stainless steel while a filler of silicon carbide is more efficient on carbon steels.

In formulating abrasive wheel compositions the resin and fillers are usually combined and designated as the "bond" which is mixed with the abrasive particles and other processing ingredients such as wetting agents to provide a hot pressable and a heat post-curable wheel molding composition.

Presently hot pressed steel conditioning snagging wheels contain from 50 to 60 volume percent abrasive with the remainder being "bond" containing at least 42% and often as much as 70% by volume of phenolic resin with the rest being filler.

Up until this discovery it has been considered that wheel durability was largely a function of abrasive content. Loring Coes, Jr., a leading authority on abrasive and grinding wheels stated on page 14 of a book entitled "Abrasives" published in 1971 by Springer Verlag of Wien and New York, "a distinct gain in durability of the wheels can be obtained by using highest possible abrasive content" in organic bonded wheels for severe duty applications.

Contrary to the prior art teachings the herein named inventors have unexpectedly discovered that excellent performance can be obtained from comparable resinoid bonded snagging wheels which have an abrasive content far below current practice by increasing filler content of the wheel and maintaining the resin content of the wheel substantially constant.

U.S. Pat. No. 3,632,320 to Yoshimoni Henmi et al also teaches that grinding efficiency decreases if less than 50% by weight (32% by volume) of abrasive is put into the wheel and the filler content is limited to a maximum of 40% by weight (44% by volume).

Zalud in his U.S. Pat. No. 2,734,813 discloses solving a wheel glazing problem by providing abrasive articles with high filler and relatively low resin content bonds. He teaches utilizing 7–14 parts by weight of thermoset resin binder to 160 parts by weight of abrasive and a filler material comprising 67–95% by weight of the bond which includes the resin binder portion. The essential feature of Zalud invention is to reduce the resin content whereas the instant invention has the object of maintaining a substantially constant volume of resin in wheels with an abrasive content of from 24–45% by volume. Thus, in wheels of the invention the proportion of resin to abrasive actually increases as the abrasive content is decreased.

On the 160 units by weight basis as used by Zalud a standard snagging wheel with 60% by volume of abrasive contains 19.2 units of resin by weight and the invention wheel with 30% volume of abrasive would contain 38.2 units of resin by weight. These figures are well above the 7–14 units taught and claimed by Zalud.

The use of abrasive contents as low as 40% by volume has been taught by Rue et al in U.S. Pat. No. 3,183,071, and Kistler et al in U.S. Pat. Nos. 3, 156,545 and 3,481,723. The example given in U.S. Pat. No. 3,183,071 is based on the displacement molding technique of U.S. Pat. No. 2,860,961 in which the bond is prepared as a hot viscous fluid unsuitable for a standard hot pressing process. In Kistler et al, U.S. Pat. No. 3,156,545 the example wheel consists of 56 volume % abrasive, 21.6% phenolic resin, 7.41% wetting agents and the balance, 15% as filler.

Both Kistler et al and Rue et al disclose incorporating 40% to 64% by volume of abrasive and from 36% to 60% by volume of bond of which Rue et al discloses as containing 43.3% resin and 56.7% of filler and other ingredients including 19.1% furfuraldehyde which may be considered to become part of the resin content. In a 40% by volume of abrasive wheel the bond amounts to 60% by volume which comprises 25.98% resin and the balance of 34.02% includes the other ingredients including fillers and the furfuraldehyde amounting to 11.4% by volume of the wheel. Thus, the 40% abrasive wheel will have (including the furfuraldehyde) a resin content of 37.44% and a reduced filler content (excluding the furfuraldehyde) of 22.56% by volume of the wheel.

Charvat in U.S. Pat. No. 3,864,101 discloses abrasive articles which may contain on a basis % by volume 30 to 50% of 600 to 10 grit size abrasive particles, 26.7 to 53% organic resinous stress absorbing spacer material which includes both cured powder and liquid forms of the resin, about 4% to 24.2% of inorganic filler or spacer material and 0.5% to 25% pores.

The prior art methods of wheel formulation substitutes bond for abrasive to produce softer acting wheels. Since abrasive goes down, the bond including both the filler and resin content goes up. In the invention, the volume of abrasive is much lower and replaced solely by the filler while the resin remains substantially constant with relation to the total wheel.

DISCLOSURE OF THE INVENTION

Organic bonded abrasive bodies of high grinding efficiency, such as hot pressed reinforced or non-reinforced snagging wheels for conditioning slabs, billets, castings and the like which have an abrading portion of substantially zero porosity, relatively low abrasive, high filler and substantially constant resin content are disclosed.

The abrading portion of the abrasive body or wheel may comprise 24% to 45% by volume of 4 to 36 grit size abrasive particles suitable for snagging metal, 18% to 24% by volume of an organic thermosetting resin and 29% to 56% by volume of filler material containing at least 80% to 100% by volume of inorganic material.

Additionally, the abrading portion may contain 0 to 5% by volume of wetting agents and from 0 to about 8% by volume of pores or voids.

If desired, the abrasive bodies or wheels may be reinforced with suitable and conventional discs of open mesh fiber glass cloth, glass or other fibers and/or with a strong inner non-abrading fine center portion adjoining the outer abrading portion of the body or wheel.

BEST MODE FOR CARRYING OUT THE INVENTION

The organic bonded abrasive bodies of the invention are preferably hot pressed snagging wheels of substantially zero porosity normally utilized to condition steel billets, slabs and castings. It has been discovered that the efficiency of such wheels can be maintained and in some instances improved by reducing the abrasive content well below the 50–60% volume of the wheel that was taught to be necessary to maintain grinding efficiency. The abrasive bodies and wheels of the instant invention have an outer grinding or abrading portion containing from 24% to 45% by volume of any well known conventional abrasive material suitable for the application. Preferably the abrasive material suitable for snagging applications are selected from fused aluminum oxide, fused alumina-zirconia, sintered alumina-zirconia, sintered alumina, sintered bauxite, silicon carbide and mixtures thereof.

These may be employed in a number of usual and conventional grit sizes well known in the art. Preferably for snagging wheels the grit size is relatively coarse and can range from 4 to 36 grit size.

A conventional organic resinoid binder may be mixed with a variety of fillers to bind the wheel composition together.

Preferably the organic binder is a thermosettable mixture of powdered phenolic novolac and 10% of the cross-linking aid hexamethylenetetramine known in the art as Varcum 29346 standard long flow thermosetting phenolic resin available from Reichold Chemical Inc., Varcum Division, Niagara Falls, N.Y.

However, other formulations of thermosetting phenolic novolac resins with 8% to 16% of hexamethylenetetramine may be employed.

Other thermosetting resins which may be employed include phenoxy, phenol-furfural, aniline-formaldehyde, urea-formaldehyde, epoxy, cresol aldehyde, resorcinal aldehyde, urea aldehyde, melamine formaldehyde, and mixtures thereof.

The thermosetting resins may be modified with small amounts of various resinous materials including epoxy resins, vinyl resins, vinyl chloride, vinyl butyral, vinyl formal, vinyl acetate, cross linking aids such as paraformaldehyde or hexamethylenetetramine and suitable plasticizer or solvents such as furfuraldehyde, propylene sulfite, cresol, furfuryl alcohol and mixtures thereof.

Preferably, the resin content of the wheels of varying abrasive content and comparable size will be substantially constant in the range 18% to 24% by volume.

As is well known, there are various organic and inorganic fillers and mixtures of fillers which may be put in abrasive bodies for improving strength, reducing cost, and most importantly for improving grinding efficiency.

The fillers are usually considered to be part of the bond and are in a finely divided state. They may include organic and inorganic materials of various particle sizes well below and much smaller than the primary grinding abrasive particles.

Suitable conventional and well known fillers are cryolite, fluorospar, magnesia, silicon carbide, alumina, sodium chloride, iron pyrites, iron sulfide, calcium oxide, potassium sulfate, potassium fluoborate, copolymer of vinylidene chloride and vinyl chloride (Saran B), polyvinylidene chloride, polyvinyl chloride, other fibers, sulfides, sulfates, halides, chlorides, fluorides, and mixtures thereof.

A suitable filler material shown in Table I is a mixture of potassium sulfate, iron sulfide, silicon carbide, copolymer of vinylidene chloride and vinyl chloride (Saran B), calcium oxide and chopped glass fiber ¼" (6 mm) long. With the exception of the copolymer of vinylidene and vinyl chloride the fillers are inorganic material. Preferably the inorganic fillers constitute at least 80% by volume of the filler material in the abrading portion of the body.

Also, abrasive bodies of the invention may be safety reinforced with various conventional inorganic fibers of short or long continous length and/or open mesh fiber glass cloth discs. The fiber glass cloth may be of known twisted or of substantially untwisted strands or rovings of continuous glass filaments.

Other means of reinforcing the wheel may be used. For example, it is well known to provide a high speed grinding wheel with, what is known in the art, as a fine hard center, disclosed by Whitcomb in U.S. Pat. No. 2,102,343, to increase the safety factor, and its resistance to bursting apart and thereby allow the wheel to operate safely at higher speeds.

The fine center usually comprises a central non-abrading portion about the axis or an inner annular non-abrading portion extending around a spindle mounting aperture and normally engaged by the clamping flanges of the drive spindle.

Adjoining and extending around the inner non-abrading hard center portion is an outer annular abrading portion comprised of an abrading composition of the invention. Thus, it is the composition of the abrading portion of the wheel to which the invention is directed as the composition of the inner hard center can vary over a wide range.

Usually, the hard center portion comprises: a mixture of inorganic particles of relatively much finer grit size than the abrasive in the abrading portion, and a thermosetting resin identical to or compatible with the resin used in bonding the abrading portion of the wheel.

However, if desired, the wheel of the invention may be provided with a fine hard center. This is done by initially dividing the wheel mold into inner and outer portions by inserting a thin annular band and filling the outer portion with an abrading composition made according to the invention and the inner portion with one of a variety of suitable mixtures of inorganic particles and thermosetting resins.

A typical and suitable fine hard center for a snagging wheel may comprise 60% by volume of 46 grit silicon carbide particles, 25% by volume of phenolic resin and 15% by volume of filler material.

Examples of compositions and ingredients for producing abrading portions of wheels and wheel segments according to the invention are shown in Tables I and IV.

A first batch of six hot pressed wheels 16" (40.64 cm) diameter×2" (5.08 cm) thick×6" (15.24 cm) diameter hole were made with a mixture of the ingredients shown in Table I including standard 14 grit 76 A (Norton extruded sintered bauxite) abrasive disclosed in U.S. Pat. No. 3,079,243 to Ueltz. The abrasive content was varied from 50 to 25% by volume of the wheel structure.

As abrasive content was decreased, filler content was increased. Resin content was held constant for the series of wheels A-D. Two additional wheels E and F were made with a 25% abrasive content and higher resin contents.

In preparing the composition for molding into wheels the ingredients of the bond, comprising the listed fillers and resin were blended together dry. Furfural was added to wet the abrasive in the amount of 15 cc per lb. (33 cc per kg. of abrasive). The bond was then mixed with the wetted abrasive and further dampened with 20 cc CARBOSOTA brand per lb. (44 cc per kg.) of resin in the mixer.

CARBOSOTA is a registered trademark for a refined coal tar creosote oil wetting agent sold by Allied Chemical and Dye Corporation.

Preferably, the wetting agents furfural and CARBOSOTA comprise less than 3% by volume of the abrading portion and may become part of the cured resin content.

However, the abrading portions may contain 0 to 5% by volume of suitable wetting agents selected from furfural, furfural alcohol, liquid resin, CARBOSOTA and mixtures thereof.

TABLE I

Wheel Composition % by Volume Excluding Pores and Wetting Agents (Furfural and CARBOSOTA)

| Wheel | A | B | C | D | E | F |
|---|---|---|---|---|---|---|
| 14 grit size 76 A sintered bauxite abrasive | 50 | 38.4 | 40.3 | 25 | 25 | 25 |
| VARCUM V29318 Powdered Resin | 19.4 | 19.2 | 19.2 | 19.2 | 24 | 28.8 |
| Potassium Sulfate ($K_2SO_4$) Powder | 4.6 | 8.2 | 8.2 | 8.2 | 8.2 | 8.2 |
| Iron Sulfide ($FeS_2$) −225 Mesh | 11 | 16.3 | 16.3 | 16.3 | 16.3 | 16.3 |
| Iron Sulfide ($FeS_2$) −40–60 Mesh | 0 | 0 | 7.7 | 13.4 | 13.4 | 11.2 |
| Silicon Carbide (SiC) −325 Mesh | 6.4 | 9.6 | 0 | 9.6 | 3.6 | 0 |
| Copolymer of Vinylidene and Vinyl Chloride | | | | | | |

TABLE I-continued

Wheel Composition % by Volume Excluding Pores and Wetting Agents (Furfural and CARBOSOTA)

| Wheel | A | B | C | D | E | F |
|---|---|---|---|---|---|---|
| (Saran B) | 1.8 | 1.4 | 1.4 | 1.4 | 1.8 | 2.2 |
| Calcium Oxide (Lime (CaO)) | 2.8 | 2.9 | 2.9 | 2.9 | 3.7 | 4.3 |
| Chopped Glass Fibers ¼" (6mm) | 4 | 4 | 4 | 4 | 4 | 4 |

The prepared mix of abrasive and bond was placed in a mold and hot pressed at 2½ tons/in$^2$ (351.5 kg/cm$^{22}$) and 160° C. for one hour. Then the wheels were stripped from the molds and postcured for 24 hours at 200° C.

The cured wheels were then tested by grinding for 30 minutes each on 18-8 stainless steel using 400 lbs. (181.4 kg) head pressure and a wheel speed of 9500 sfpm (48.3 smps). The comparative grinding results are shown in the following Tables II and III.

TABLE II

Grinding Test Results on 18-8 Stainless Steel

| Wheel | 76 A 14 Grit Abrasive Content % (Vol.) | Wheel Wear/hr. in$^3$ | (dm$^3$) | Metal Removal /hr. Lbs. | (Kg) | Grinding Ratio Lbs/in$^3$ | (KG/dm$^3$) |
|---|---|---|---|---|---|---|---|
| A | 50 | 25.19 | (.4129) | 141.40 | (64.14) | 5.61 | (155.3) |
| B | 38.4 | 24.41 | (.4000) | 144.90 | (65.73) | 5.94 | (164.3) |
| C | 40.3 | 25.77 | (.4224) | 148.50 | (67.36) | 4.76 | (159.5) |
| D | 25 | 36.61 | (.6000) | 174.40 | (79.24) | 4.77 | (132.0) |
| E | 25 | 32.44 | (.5316) | 164.30 | (74.53) | 5.07 | (140.2) |
| F | 25 | 37.98 | (.6225) | 158.80 | (72.03) | 4.18 | (155.7) |

TABLE III

Relative Grinding Test Results in Percent

| Wheel | % Wheel Abrasive Content | Wheel Wear | Metal Removal | Grinding Ratio |
|---|---|---|---|---|
| A | 50 | 100 | 100 | 100 |
| B | 38.4 | 97 | 102 | 106 |
| C | 40.3 | 102 | 105 | 103 |
| D | 25 | 145 | 124 | 85 |
| E | 25 | 129 | 116 | 90 |
| F | 25 | 151 | 112 | 74 |

These results show that grinding wheel efficiency reaches a maximum at about 38% by volume abrasive in the wheel. Also that the 25% abrasive wheel cuts 16% faster than the 50% abrasive standard wheel A with a G-ratio only 10% less.

G-Ratio represents the quantity of metal removed per volume of wheel and is a frequently used measure by wheel consumers. This again shows about 38% abrasive outperforming 50%. Also, we see that composition E (25% abrasive) with slightly more resin content has a grinding ratio about 90% of A, even through E contains only half as much abrasive as A. This increased efficiency in the utilization of abrasive shows that a 25% abrasive wheel will remove almost twice as much metal per unit of abrasive compared to a 50% abrasive wheel.

Also, we see that wheel F with 25% abrasive, more resin and less filler did not perform as well as wheels E and D.

A second batch of low abrasive, high filler and constant resin content hot pressed snagging wheels of substantially zero porosity 16" (40.64 cm) diameter×2" (5.08 cm) thick×6" (15.24 cm) diameter holes were made and tested. The composition of the wheels made and tested are shown in the following Table IV.

TABLE IV

| Wheel Composition % by Volume Excluding Pores and Wetting Agents (Furfural and CARBOSOTA) | | | | |
|---|---|---|---|---|
| Wheel | G | H | I | J |
| 76A sintered bauxite abrasive −12 grit | 60 | 50 | 40 | 30 |
| Varcum 29346 phenolic powdered resin | 20.8 | 20.8 | 20.8 | 20.8 |
| Iron Pyrites ($FeS_2$) (−60 mesh) | 6.8 | 11.8 | 16.8 | 21.8 |
| Cryolite (−200 mesh) | 6.8 | 11.8 | 16.8 | 21.8 |
| Saran B (Copolymer of Vinylidene & Vinyl Chloride | 2.4 | 2.4 | 2.4 | 2.4 |
| Lime (CaO) | 3.2 | 3.2 | 3.2 | 3.2 |
| | 100.0 | 100.0 | 100.0 | 100.0 |

In contrast to the compositions shown in Table I, the compositions shown in Table IV show the wheels varying from the current practice of 60% by volume of abrasive down to 30% by volume. Each wheel had a mixture of the same type of conventional fillers some of which differ from those shown in Table I. The volume of resin content was constant for each of the wheels but the wheel did not contain chopped glass fibers. Also a coarser or larger 12 grit size 76A (Norton extruded sintered bauxite) abrasive was put into each of the wheels.

The bond and 12 grit size 76A (Norton extruded sintered bauxite) were prepared and mixed in the same conventional manner as before. The abrasive mix was then put into a mold and hot pressed at 2½ tons/in$^2$ (351.5 Kg/cm$^2$ pressure and 160° C. for one hour and post cured for 24 hours at 175° C.

The wheels were tested by grinding and their performance compared with that of the wheel containing 60% by volume of abrasive rated at 100%.

Grinding was conducted on 304 stainless steel billets with a head pressure of 400 lbs. (181.6 kg) at 9500 sfpm (48.3 smps) for 30 minutes each.

Results of the grinding test are shown in the following Tables V and VI.

TABLE V

| Grinding Test Results on 304 Stainless Steel | | | | | | | |
|---|---|---|---|---|---|---|---|
| | 76A12 Abrasive | Wheel Wear/Rate | | Metal Removal/Rate | | Grinding Ratio | |
| Wheel | (vol %) | in$^3$/hr | (dm$^3$/hr) | Lbs./hr | (Kg/hr) | Lbs./in$^3$ | (KG/dm$^3$) |
| G | 60% | 36.21 | (0.5935) | 173.10 | (78.52) | 4.78 | (132.3) |
| H | 50% | 28.94 | (0.4744) | 162.20 | (73.57) | 5.60 | (155.1) |
| I | 40% | 23.39 | (0.3834) | 160.60 | (72.85) | 6.87 | (190.0) |
| J | 30% | 33.53 | (0.5495) | 167.40 | (75.93) | 4.99 | (138.2) |

TABLE VI

| Relative Tests Results in Percent | | | | |
|---|---|---|---|---|
| Wheel | Volume 76A12 Abrasive | Wheel Wear Rate | Metal Removal Rate | Grinding Ratio |
| G | 60% | 100 | 100 | 100 |
| H | 50% | 80 | 94 | 117 |
| I | 40% | 65 | 93 | 144 |
| J | 30% | 93 | 97 | 104 |

The test results shown in Table V and VI indicate that a 50% reduction in abrasive content from the current practice of 60% by volume was possible without any loss in the cut rate or Grinding Ratio. More importantly a 33⅓% reduction in abrasive from 60% to 40% by volume increased the Grinding Ratio 44% with only a 7% reduction in the Metal Removal Rate which was practically constant over the 30% to 60% abrasive range of wheels G to J.

Also shown is that the Grinding Ratio peaked at about 40% by volume and surprisingly the Grinding Ratio of the 30% by volume wheel J was slightly better than the standard 60% volume abrasive wheel G. Although the 30% wheel J had a lower grinding ratio its metal removal rate was greater than the 50% and 40% wheels H and I and only slightly less than the 60% wheel G.

Although it is not specifically disclosed it is obvious that the invention can be utilized in other forms of organic bonded abrasive bodies. Especially, in abrasive bodies containing relatively coarse abrasive particles of 36 grit size and larger which are subjected to high speed, high pressures and temperatures and which need to be strong and remove metal rapidly.

Examples of such abrasive bodies are unitary cylindrical peripheral face abrading wheels, rotary disk or radial face wheels and abrasive segments for both cylindrical and radial segmental wheels, usually mounted in a rotary chuck adapted for attaching it to the drive spindle of a machine.

Thus it has been shown that the invention disclosed hereinabove is a significant and unexpected advancement in the state of the art to which it pertains.

As many embodiments and modifications of the invention are possible, it is to be understood that the invention is not limited to the specific embodiments disclosed but includes all embodiments, modifications and equivalents thereof falling within the scope of the appended claims.

We claim:

1. An organic bonded abrasive body having an abrading portion suitable for snagging metal and wherein the abrading portion comprises:

24% to 45% by volume of from 4 to 36 grit size abrasive particles selected from a group consisting of fused aluminum oxide, fused alumina-zirconia, sintered alumina, sintered bauxite, sintered alumina-zirconia, silicon carbide, and mixtures thereof, 18% to 24% by volume of thermosetting resin, 0 to 8% by volume of pores, and 29% to 56% by volume of filler material containing at least 80% by volume of inorganic material.

2. An organic bonded abrasive body according to claim 1 wherein the thermosetting resin is selected from a group consisting of phenol-formaldehyde, phenol-furfural, aniline-formaldehyde, urea-formaldehyde, phenoxy, and epoxy.

3. An organic bonded abrasive body according to claim 1 wherein the filler material is selected from the group consisting of iron pyrites, potassium sulfate, cryolite, iron sulfide, fluorspar, sodium chloride, potassium fluoborate, silicon carbide, magnesia, alumina, calcium oxide, chopped glass fibers, copolymer of vinylidene chloride and vinyl chloride, polyvinylidene chloride, polyvinyl chloride, and mixtures thereof.

4. An organic bonded abrasive body according to claim 1 wherein the filler material is a mixture of iron pyrites, cryolite, calcium oxide and a copolymer of vinylidene chloride and vinyl chloride and the thermosetting resin is a phenolic.

5. An organic bonded abrasive body according to claim 1 wherein the filler material is a mixture of potassium sulfate, iron pyrites, calcium oxide, chopped glass fiber and a copolymer of vinylidene chloride and vinyl chloride.

6. An organic bonded abrasive body according to claim 5 wherein the mixture of filler material further comprises:

silicon carbide of smaller particle size than the abrsive particles and wherein the thermosetting resin is phenolic.

7. An organic bonded abrasive body according to claim 1 wherein the abrasive body is a grinding wheel comprising:

an outer abrading portion and a strong non-abrading fine center portion adjoining the abrading portion and extending around a central axis of the wheel and radially inwardly from the adjoining abrading portion.

8. An organic bonded abrasive body according to claim 1 wherein the filler material is selected from the group consisting of inorganic sulfides, inorganic sulfates, organic and inorganic halides, metal oxides, metal carbides, fibers and mixtures thereof.

9. An organic bonded abrasive body according to claim 8 wherein the inorganic sulfides filler material is selected from the group consisting of iron sulfide, iron disulfide, iron pyrites and mixtures thereof.

10. An organic bonded abrasive body according to claim 8 wherein the inorganic sulfate filler material is potassium sulfate.

11. An organic bonded abrasive body according to claim 8 wherein the inorganic or organic halides filler material is selected from the group consisting of cryolite, fluorspar, sodium chloride, potassium fluoborate, copolymer of vinylidene chloride and vinyl chloride, polyvinylidene chloride, polyvinyl chloride and mixtures thereof.

12. An organic bonded abrasive body according to claim 8 wherein the metal oxides filler material is selected from the group consisting of magnesia, alumina, calcia and mixtures thereof.

13. An organic bonded abrasive body according to claim 8 wherein the inorganic carbide filler material is silicon carbide.

14. An organic bonded abrasive body according to claim 8 wherein the fibers are chopped glass fibers.

* * * * *